US006130498A

United States Patent [19]

Shimizu et al.

[11] Patent Number: 6,130,498

[45] Date of Patent: Oct. 10, 2000

[54] SPARK PLUG WITH SPECIFIC MEASURED PARAMETERS

[75] Inventors: Toshikazu Shimizu, Okazaki; Yasushi Kawashima, Inabe-gun, both of Japan

[73] Assignee: Denso Corporation, Kariya, Japan

[21] Appl. No.: 09/207,661

[22] Filed: Dec. 9, 1998

[30] Foreign Application Priority Data

| | | | |
|---|---|---|---|
| Dec. 26, 1997 | [JP] | Japan | 9-369156 |
| Dec. 27, 1997 | [JP] | Japan | 9-369060 |
| Jan. 9, 1998 | [JP] | Japan | 10-015009 |
| Nov. 4, 1998 | [JP] | Japan | 10-313386 |
| Nov. 5, 1998 | [JP] | Japan | 10-314919 |
| Nov. 11, 1998 | [JP] | Japan | 10-320865 |

[51] Int. Cl.[7] ..... H01T 13/20

[52] U.S. Cl. ..... 313/141; 313/143

[58] Field of Search ..... 313/135, 136, 313/137, 141, 143, 144, 145

[56] References Cited

U.S. PATENT DOCUMENTS 5,514,929 5/1996 Kawamura .

FOREIGN PATENT DOCUMENTS 61-93575 5/1986 Japan .
64-2384 1/1989 Japan .
9-18056 7/1997 Japan .

*Primary Examiner*—Vip Patel
*Attorney, Agent, or Firm*—Nixon & Vanderhye P.C.

[57] ABSTRACT

A spark plug has an insulator having a through hole extending in an axial direction thereof and an insulator leg portion at an end thereof, a resistor disposed in the through hole, a central electrode disposed in the through hole to face a central electrode side end face of the resistor and protruding from an insulator end face of the insulator leg portion, and a housing holding the insulator. A length between the insulator end face and the central electrode side end face of the resistor is equal to or larger than 1.5 times as large as a length of the insulator leg portion in the axial direction. Accordingly, temperature at a contact portion between the resistor and the central electrode is prevented from being increased, resulting in long life of the spark plug.

21 Claims, 12 Drawing Sheets

SPARK PLUG WITH SPECIFIC MEASURED PARAMETERS

CROSS REFERENCE TO RELATED APPLICATIONS

This application is based upon and claims the benefit of priority of the prior Japanese Patent Applications No. 9-369156, filed on Dec. 26, 1997, No. 9-369060, filed on Dec. 27, 1998, No. 10-15009, filed on Jan. 9, 1998, No. 10-313386, filed on Nov. 4, 1998, No. 10-314919 filed on Nov. 5, 1998, and No. 10-320865 filed on Nov. 11, 1998, the contents of which are incorporated herein by reference.

BACKGROUND OF THE INVENTION

1. Field of the Invention

This invention relates to a spark plug for an internal combustion engine suitable for a vehicle, a cogenerator, a gas transporting pump, or the like.

2. Description of the Related Art

A large engine, which is applied to a large generator using gaseous fuel (cogenerator), a gas transporting pump, or the like, usually includes a large spark plug having, for example, a housing outer diameter of 18 mm, an insulator head portion diameter of 14 mm, a central electrode diameter of 2.5 mm, and an entire length of 115 mm. This kind of large engine is always operated without intervals. Therefore, the large spark plug for the engine is especially required to have long life in order to improve a maintenance property and in order to reduce plug exchanging cost.

As shown in FIG. 1, this kind of spark plug 90 typically has an insulator 4 and a resistor 69 disposed in a through hole 41 of the insulator 4. In the through hole 41, a central electrode 2, a low melting point glass 70, and a conductive sintered member 71 are disposed on a side of the resistor 69, and a terminal electrode 21 and a spring 23 fixing the resistor 69 are disposed on the other side of the resistor 69. A housing 5 holds the insulator 4, and an earth electrode 3 and a screw portion 52 for attachment are provided on the housing 5. The central electrode 2 and the earth electrode 3 define a spark gap G therebetween. The resistor 69 is for lowering radio noise caused by spark discharge, and disposed adjacently to the spark gap G to sufficiently prevent the radio noise. The resistor 69 is formed by sintering and pressing resistive powders as a solid resistor, or by welding resistive material including glass powders such as borosilicate system glass, ceramic powders such as zirconia, and carbon system resistive material such as carbon black in a high temperature furnace and forming into a columnar shape.

The spark gap G needs to be prevented from being enlarged and required voltage necessary for causing spark discharge needs to be prevented from being increased, in order to secure long life of the spark plug 90. Because of this, a noble metal cap 28 made of noble metal or an alloy of the noble metal is used as a discharge member. Recently, however, the large gas engine has been required to improve combustion efficiency and to be operated under high compression and a lean-burn state so that fuel consumption is improved and so that an amount of exhaust gas is decreased. Accordingly, the spark plug 90 is forced to be operated under hard conditions such as increases in required voltage, thermal load, ignition energy, and the like.

When the spark plug 90 is operated under such hard conditions, the resistor 69 disposed adjacently to the spark gap G is exposed to high temperature for a long time period to have increased resistance. The increased resistance of the resistor 69 may cause ignition failure of the engine. Further, sealing property can easily deteriorate due to high pressure gas passing through an interval between the central electrode 2 and the through hole 41.

SUMMARY OF THE INVENTION

The present invention has been made in view of the above problems. An object of the present invention is to provide a spark plug suitable for an internal combustion engine and including a resistor capable of maintaining its characteristics for a long period of time. Another object of the present invention is to provide a spark plug having-long life.

According to a first aspect of the present invention, a spark plug has an insulator having a through hole extending in an axial direction thereof and an insualtor leg portion at a first end portion thereof, a resitor disposed in the through hole, and a central electrode disposed in the through hole to face a central electrode side end face of the resistor and protruding from an insulator end face of the insulator leg portion. A length between the insulator end face and the central electrode side end face of the resistor is equal to or larger than 1.5 times as large as a length of the insulator leg portion in the axial direction. Accordingly, a temeprature at a contact portion between the central electrode and the central electrode side end face of the resistor is prevented from being increased due to heat transmitted from an internal combustion engine. As a result, the resistor is prevented from being burned.

Accordng to a second aspect of the present invention, a spark plug has an insulator having insulator first and second end faces in an axial direction thereof, a central electrode protruding from the insulator first end face, a terminal electrode electrically connencted to the central electrode and protruding from the insualtor second end face, and a housing holding at least part of the insulator on a cnetral electrode side. An entire length of the insulator between the insualtor first and second end faces is equal to or larger than 90 mm, a length between the insulator second end face and an end face of the housing on an insulator second end face side is equal to or larger than 40 mm, and a projection area of the insulator second end face is in a range of 80 $mm^2$ to 200 $mm^2$. As a result, the insulator can be formed without being deformed, so that a sealing property between the insulator and a cap seal is improved, resulting in long life of the spark plug.

According to a third aspect of the present invention, a cylindrical housing is disposed on an outer circumference surface of an insulator, and has a polygonal attachment portion for being rotated when the spark plug is attached to an internal combustion engine and a sleeve portion on a side of the screw portion opposite an insulator first end face, from which a central electrode protrudes. The sleeve portion forms a ring-shaped space with the outer circumference surface of the insulator by caulking, and the ring-shaped space is filled with a powdery layer. A length of the powdery layer in an axial direction of the insulator is in a range of 5 mm to 8 mm, and a length of the polygonal attachment portion in the axial direction is in a range of 10 mm to 15 mm. Preferably, the housing has a thin groove portion on a side of the attachment portion opposite the sleeve portion and a thick protruding portion on a side of the groove portion opposite the attachment portion, and the sleeve portion is caulked by applying a compressive stress between the sleeve portion and the protruding portion in the axial direction. Accordingly, the sealing property is improved, and the spark plug can have long life.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS (First Embodiment)

Figure 1:
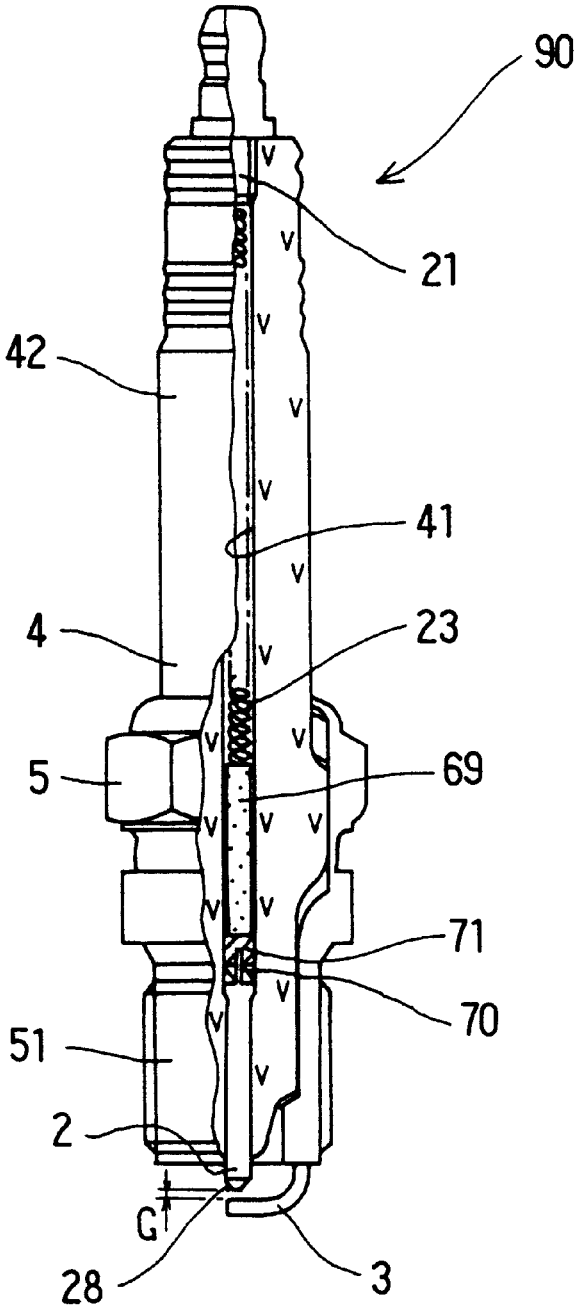
FIG. 1 PRIOR ART
FIG. 1 is a partially cross-sectioned front view showing a spark plug in a prior art.

A spark plug 10 in a first referred embodiment will be explained referring to FIGS. 2 and 3, in which the same parts as those in FIG. 1 are indicated by the same reference numerals as those in FIG. 1.

Figure 2:
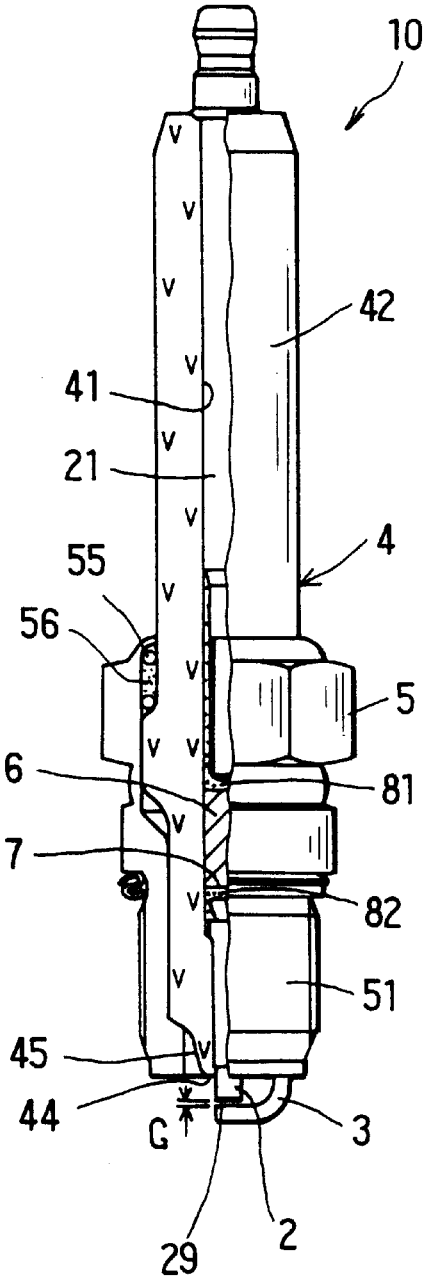
FIG. 2 is a partially cross-sectioned front view showing a spark plug in a first preferred embodiment.
Figure 3:
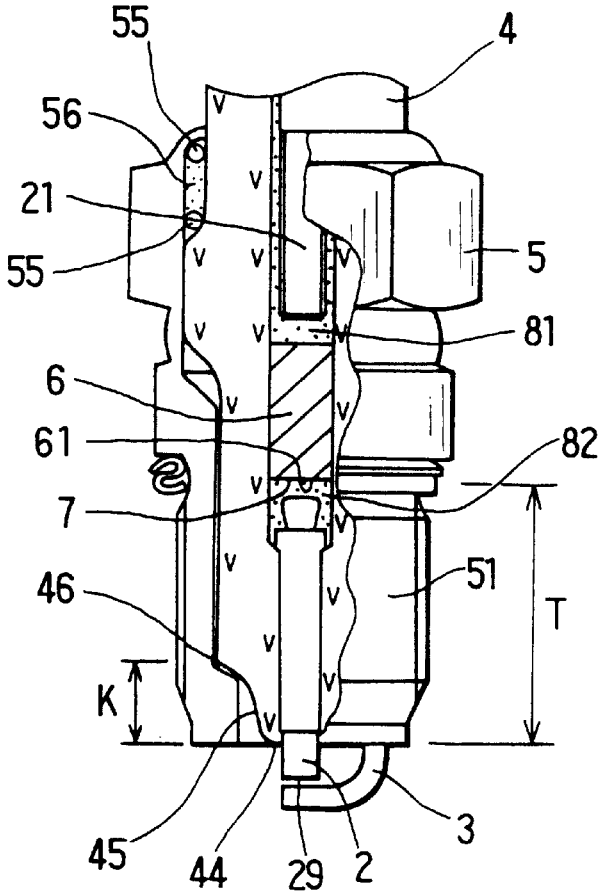
FIG. 3 is a partially cross-sectioned front view showing in the vicinity of a welded columnar resistor in the spark plug shown in FIG. 2.

As shown in FIGS. 2 and 3, the spark plug 10 has an insulator 4, a housing 5 for holding the insulator 4, and an earth electrode 3 fixed to the housing 5. The insulator 4 has a through hole 41 extending in the insulator 4 in an axial direction and a welded columnar resistor 6 is disposed in the through hole 41. A central electrode 2 is disposed at an end of the resistor 6 via a central electrode side glass seal 82 and a terminal electrode 21 is disposed at the other end of the resistor 6 via a terminal electrode side glass seal 81 within the through hole 41. The housing 5 has a screw portion 51 for being attached to an engine block of an internal combustion engine. The central electrode 2 and the earth electrode 3 define a spark gap G therebetween.

As shown in FIG. 3, when a length between a front end face 44 of the insulator 4 on a central electrode side and a front end face 61 of the resistor 6 on the central electrode side is T mm and a length of a leg portion 45 of the insulator 4 is K mm, a relation of $T \geqq 1.5$ K holds. The length of the leg portion 45 corresponds to a length between the front end face 44 and an end portion 46 of a lower side straight portion of the insulator 4. Incidentally, when the spark plug 10 is attached to the internal combustion engine, the leg portion 45 is disposed in a combustion chamber.

The spark plug 10 has a large size as compared to an ordinal spark plug. That is, in the spark plug 10, a diameter and a screw reach of the screw portion 51 of the housing 5 are 18 mm and 20.6 mm, respectively. A diameter and a length of a head portion 42 of the insulator 4 are 14 mm and 54 mm, respectively. The resistor 6 is formed by welding a mixture composed of carbon black as a resistive material, zirconia powder, and borosilicate system glass, at a temperature of 870° C., to have a columnar shape having a diameter of 5 mm and a length of 10 mm. Further, although a head portion of a conventional spark plug has corrugations on an outer circumference thereof (see FIG. 1), as shown in FIG. 2, the head portion 42 of the spark plug 10 does not have any corrugations on an outer circumference thereof. Incidentally, rings 55 and talc 56 are disposed at a caulked portion of the insulator 4 and the housing 5 to seal the caulked portion.

Further, the front end face of the resistor on the insulator head portion side is closer to the central electrode side than the front end portion of the housing 5 on the insulator head portion side. Accordingly, field intensity is effectively suppressed by a shield portion of the housing 5. When the front end face of the resistor 60 on the insulator head portion side is disposed on a side of the front end portion of the housing 5 opposite the central electrode, the field intensity cannot be suppressed and noise intensity may be increased.

Next, features and effects in the embodiment will be explained. The welded columnar resistor 6 is disposed such that the length T between the insulator front end face 44 and the resistor front end face 61 becomes equal to or more than 1.5 times as large as the length K of the insulator leg portion 45. Accordingly, even when a temperature of a central electrode front end portion 29 rises up to 700° C., because the length T is sufficient for preventing a temperature at a contact portion 7 between the resistor 6 and the central electrode 2 from being increased by the heat transmitted from the central electrode 2. In a combustion chamber, a front end portion of the leg portion 45 has the highest temperature in the entire leg portion 45 due to the heat transmitted from the central electrode 2.

In the first embodiment, the length T is 1.5 times as large as the length K of the leg portion 45. The contact portion 7 between the resistor 6 and the central electrode side glass seal 82 is disposed at a position deeper than a base 46 of the insulator leg portion 45. That is, the contact portion 7 is provided apart from the central electrode front end portion 29 than the base 46. Accordingly, high temperature combustion heat generated in the internal combustion engine is not directly transmitted to the contact portion 7 between the resistor 6 and the central electrode side glass seal 82, so that the temperature of the contact portion 7 is not easily increased. As a result, contact resistance at the contact portion is not increased and the contacting state between the resistor 6 and the glass seal 82 is stably kept. The resistor 6 is not burned and the engine can be securely ignited by the spark plug. It should be noted that the length T is preferably less than three times as large as that of the length K in view of noise prevention.

In the first embodiment, the resistor 6 includes a carbon system resistive material. Therefore, the resistor 6 provides sufficient high temperature fire resistance, and the contacting state between the resistor 6 and the glass seal 82 is kept at its stable state. Because the glass seals 81, 82 are disposed at the both ends of the resistor 6, the through hole of the insulator 4 can be hermetically sealed even when a combustion gas pressure is increased, resulting in high reliability of the spark plug 10. The glass seal 81, 82 are preferably made of copper glass capable of being welded together with the resistor 6. Consequently, the resistor characteristics can be stably kept for an extended time period, resulting in long life of the spark plug 10. Incidentally, because the head portion 42 of the spark plug 10 has no corrugations on the outer circumference thereof, the strength of the insulator 4 in a radial direction can be improved, and the insulator 4 hardly bends when it is sintered.

The effects in the embodiment described above were confirmed by the following test.

Figure 4:
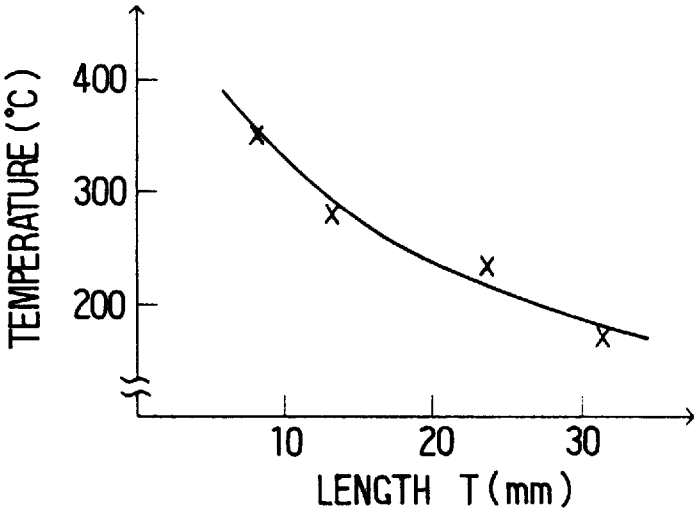
FIG. 4 is a graph showing a relationship between a length T between a central electrode front end portion and a resistor front end portion and a temperature at a contact portion between the resistor and a central electrode in the first embodiment.

First, a relationship between the length T and the temperature at the contact portion 7 was examined. That is, several spark plugs having constant length K of the leg portion 45 (K=7 mm) and various lengths T, respectively, were prepared and then the temperatures at the contact portions 7 of the respective spark plugs were measured. The other features of the spark plug were the same as those shown in FIGS. 2 and 3. In the measurement test, a large gas engine having 40 l, 4 cycles, and 8 cylinders and using natural gas as fuel was used. The engine speed as an operational condition was 1800 rpm. The result is shown in FIG. 4. Accordingly, it is confirmed that the larger the length T between the insulator front end face 44 and the resistor front end face 61 becomes, the lower the temperature at the contact portion 7 between the resistor 6 and the glass seal 82 becomes.

Next, the spark plug 10 accommodating the welded columnar resistor 6 in the embodiment and a comparative spark plug accommodating a conventional solid resistor (prototype) were prepared, and contact resistance at the contact portion 7 between the resistor and the central electrode side glass seal 82 in the respective spark plugs was measured. The other features of the comparative spark plug are the same as those in the first embodiment. In the measurement test, the same engine described above was used. The engine speed was 1800 rpm, as well. Under these conditions, rates of contact resistance value change at the contact portions of the spark plugs were measured with respect to operation time.

Figure 6:
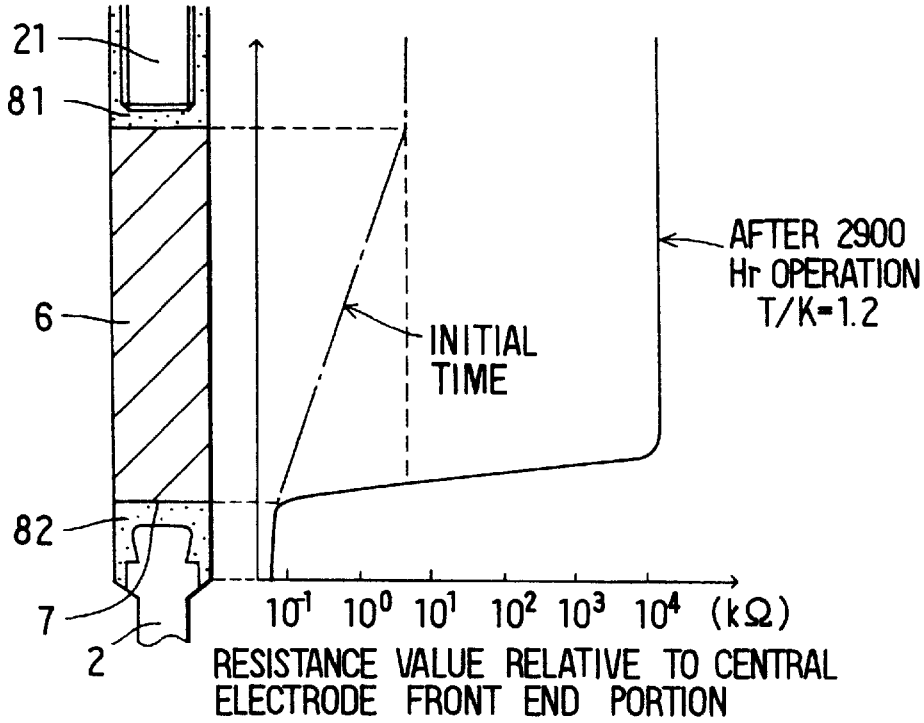
FIG. 6 is a drawing showing a change in resistance value between the central electrode front end portion and respective positions of the welded columnar resistor, before and after engine operation.

Incidentally, the rate of constant resistance value change is a value represented by $\{(R_1-R_0)/R_0\}\times 100$, in which $R_1$ is an initial of resistance value, and $R_1$ is a resistance value after operation. The resistance values were measured between the central electrode front end portion 29 and the terminal electrode 21. This is because, as shown in FIG. 6, it was confirmed that the resistance value at the contact portion 7 had approximately the same tendency as that between the central electrode side front end portion 29 and the terminal electrode 21.

Figure 5:
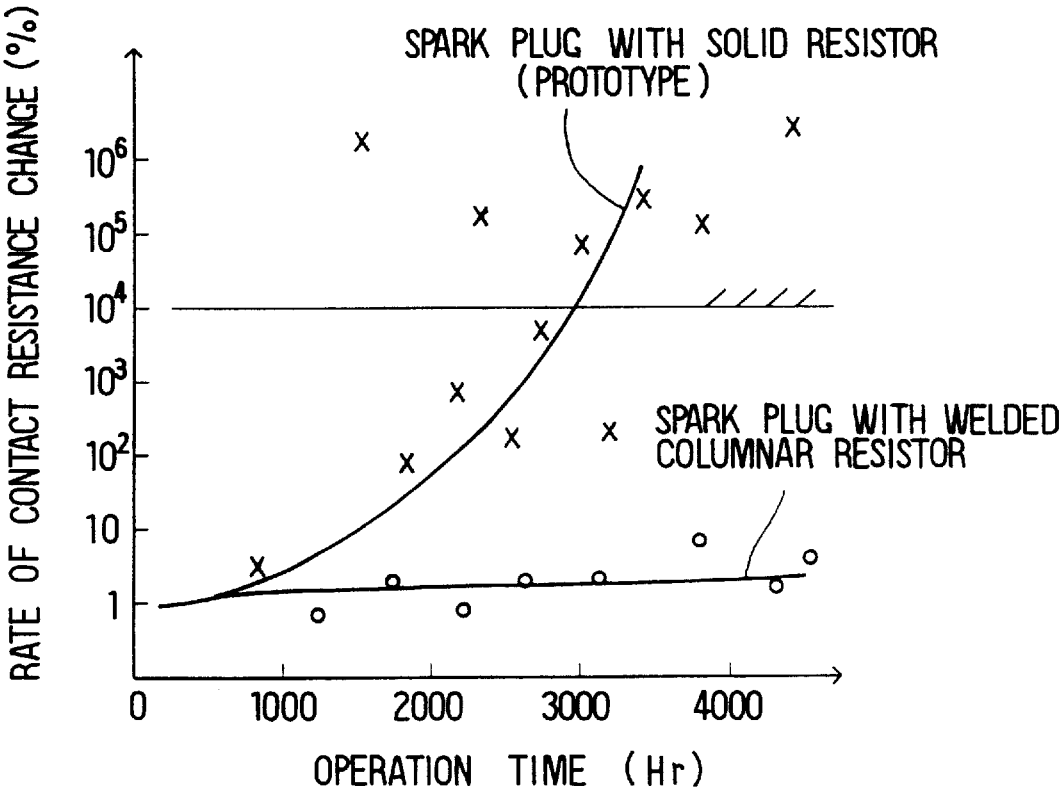
FIG. 5 is a graph showing rates of contact resistance value change at the contact portion of the spark plug with the welded columnar resistor in the first embodiment and at a contact portion of a comparative spark plug with a solid resistor.

The results are shown in FIG. 5. According to the figure, it is understood that there is prominent difference between the rates of contact resistance value change between the two spark plugs described above. That is, the rate of contact resistance value change of the comparative spark plug accommodating the solid resistor suddenly increased as the operation time elapsed, and reached $10^4$% after 3000 hours elapsed. When the rate of contact resistance value change of the spark plug exceeds $10^4$%, there arises a possibility that the engine cannot be ignited. On the other hand, the rate of contact resistance value change of the spark plug in the present invention hardly changed even after 4000-hour operation, which was the target life-time. The target lifetime is determined based on a requirement by a gas engine maker.

The reason of theses results is considered as follows. That is, concerning the conventional solid resistor, the contact resistance between the solid resistor and the glass seal becomes large because both are solid members, so that minute sparks are produced therebetween. The carbon component in the solid resistor is damaged by the minute sparks, resulting in increased resistance value of the resistor. As opposed to this, concerning the welded columnar resistor, the resistor is adhered well at the contact portion with the glass seal due to the glass component thereof, resulting in extremely small contact resistance. As a result, sparks are prevented from being produced between the central electrode and the welded columnar resistor, and the contact resistance is not changed for an extended time period.

Next, the rate of constant resistance value change at the contact portion between the resistor and the central electrode was examined with respect to a ratio T/K of the length T between the insulator front end face to the resistor front end face relative to the length K of the insulator leg portion. In this test, the same engine and the same engine speed as those for obtaining FIGS. 4 and 5 were adopted. Several spark plug with the ratios T/K of 1.0, 1.2, 1.35, 1.5, and 2.0 were prepared and were measured.

Figure 7:
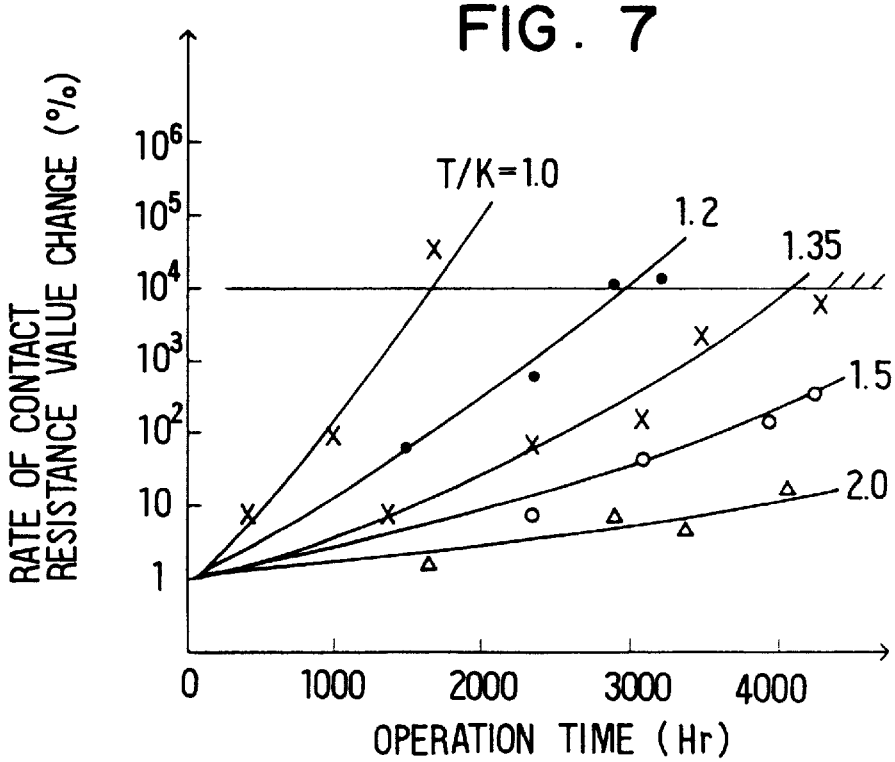
FIG. 7 is a graph showing rates of contact resistance value change at the contact portion between the central electrode and the resistor with respect to operation time, when a rate T/K is varied.

The results are shown in FIG. 7. According to the figure, it is confirmed that the larger the ratio T/K becomes, the smaller the rate of constant resistance value change becomes. It is further confirmed that when the ratio T/K is equal to or larger than 1.5, the rate of constant resistance value change can be kept smaller than $10^4$% even after 4000 hours as the target life-time elapses.

Although, in the spark plug 10 in the first embodiment, the diameter of the housing screw portion is 18 mm, the screw reach of the housing screw portion is 20.6 mm, the diameter and the length of the insulator head portion are 14 mm, 54 mm, respectively; however these dimensions of the spark plug to which the present invention can be applied are not limited. Preferably, the diameter of the housing screw portion is equal to or larger than 18 mm, the screw reach of the housing screw portion is equal to or larger than 12 mm, the diameter of the insulator head portion is equal to or larger than 12.5 mm, and the length of the insulator head portion is equal to or larger than 40 mm. In this case, the effects as described above can be effectively exhibited.

(Second Embodiment)

Next, a spark plug 10*a* in a second preferred embodiment will be explained referring to FIGS. 8–12, in which the same parts and components as those in the first embodiment are indicated by the same reference numerals.

Figure 8:
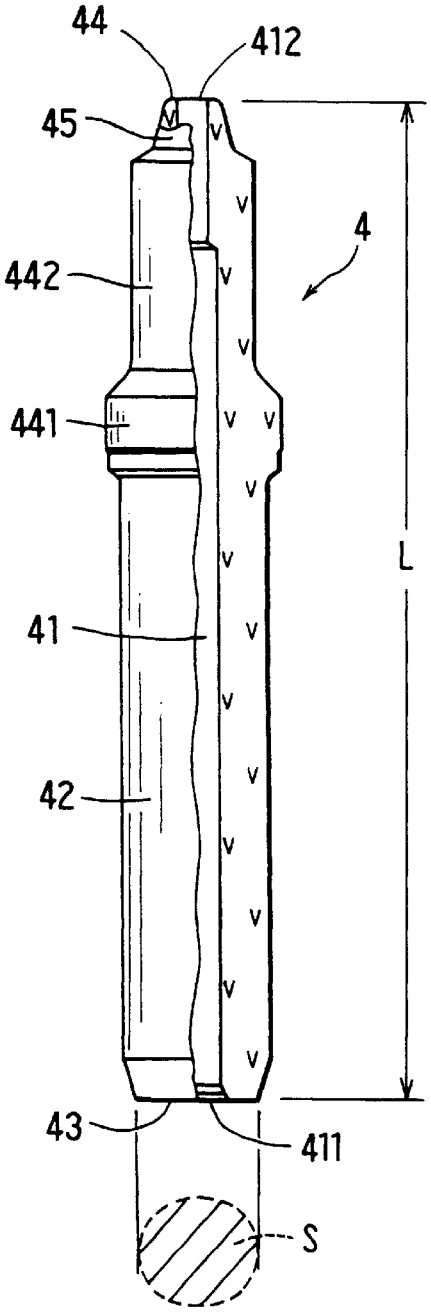
FIG. 8 is a partially cross-sectioned front view showing an insulator of a spark plug in a second preferred embodiment.
Figure 9:
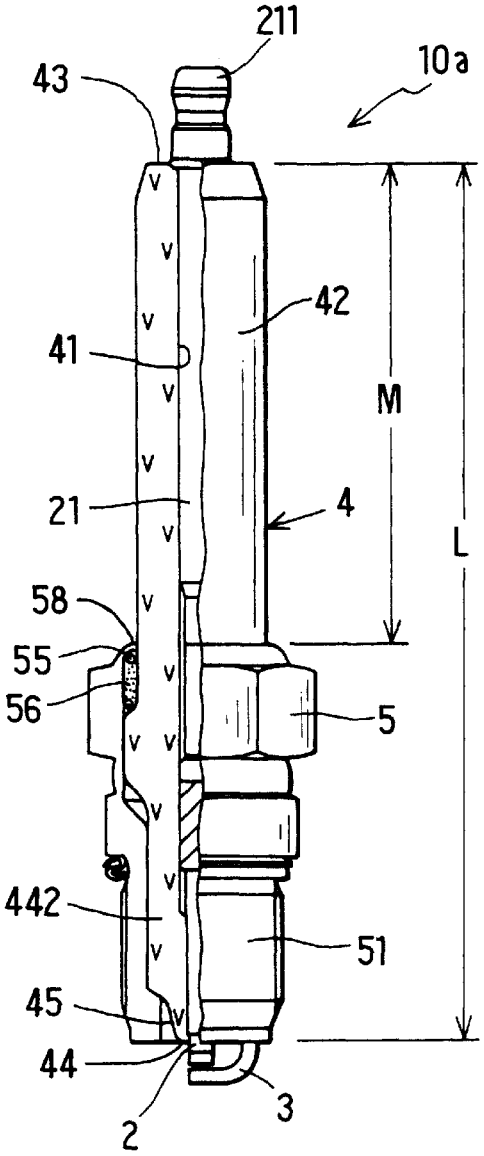
FIG. 9 is a partially cross-sectioned front view showing the spark plug in the second embodiment.

The spark plug 10*a* is a large type which is used for a large engine such as a cogenerator. As shown in FIGS. 8 and 9, the spark plug 10*a* has a central electrode 2 held in a through hole 41 of an insulator 4 and protruding from an end of the insulator 4, a housing 5 holding the insulator 4, and an earth electrode 3 provided on the housing 5. A terminal electrode 21 is inserted into the through hole 41 to be electrically connected to the central electrode 2, and has a connecting head portion 211 protruding from the other end of the insulator 4. The connecting head portion 211 is electrically connected to a terminal of a plug cord. The terminal electrode 21 except the connecting head portion 211 is inserted into and covered with the insulator 4.

An entire length L of the insulator 4 between an insulator head portion front end face 43 and an insulator leg portion front end face 44 is in a range of 90 mm to 130 mm. A length M of the insulator head portion 42 between an installation upper end face 58 of the housing 5 and the insulator head portion front end face 43 is equal to or more than 40 mm. The outer circumference face of the insulator head portion 42 is flat without having no corrugations thereon. In addition, a projection area S of the insulator head portion front end face 43 shown in FIG. 8 is in a range of 80 $mm^2$ to 200 $mm^2$. The insulator head portion 42 are generally columnar and has a generally circular cross-section.

Further, the insulator 4 has an insulator central portion 441 adjacent to the central electrode 2 more than the insulator head portion 42, an insulator lower portion 442, and a leg portion 45. The through hole 41 has a terminal electrode side opening portion 411 and a central electrode side opening portion 412. In FIG. 2, numeral 51 indicates a screw portion of the housing 5 for installation. Rings 55 and talc 56 are disposed at a caulked portion of the insulator 4 and the housing 5.

Figure 11:
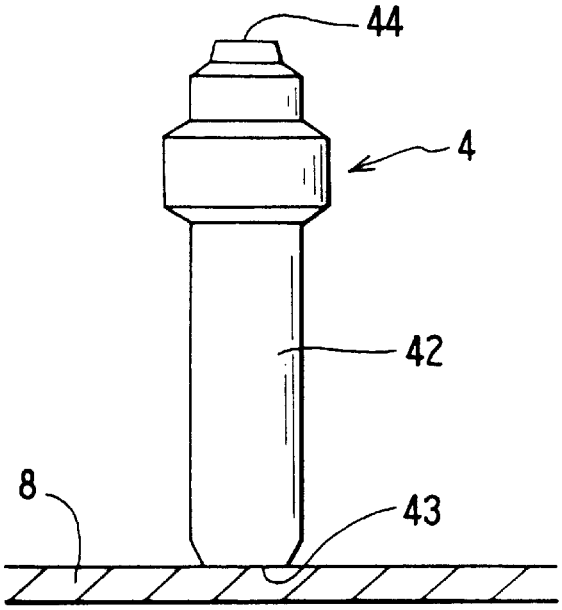
FIGS. 11 and 12 are diaphragms for explaining a problem which may be caused when an insulator is sintered.
Figure 12:
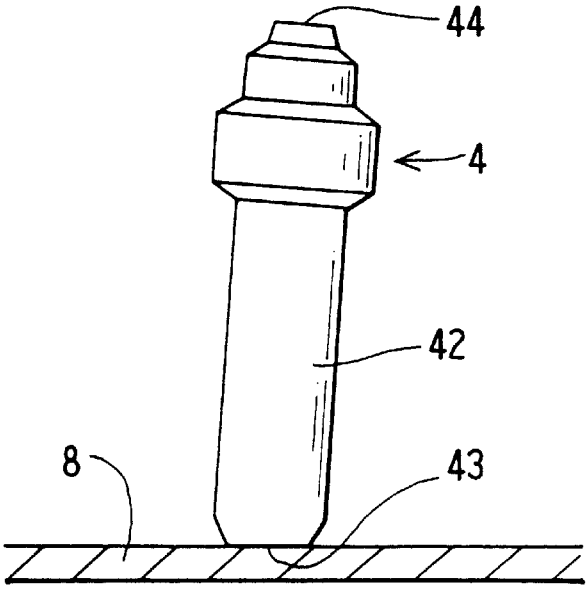

Next, features and effects in the second embodiment will be described. The insulator 4 is formed by sintering. At that time, as shown in FIG. 11, the insulator 4 is perpendicularly disposed on a sintering base 8 with the insulator head portion front end face 43 contacting the sintering base 8. This is because the insulator leg portion front end face 44 is so small that it is difficult to be stably disposed on the sintering base 8. In this embodiment, because the spark plug 10*a* has dimensions of 90 mm$\leqq$L$\leqq$130 mm, M$\geqq$40 mm, and 80 $mm^2 \leqq S \leqq 200$ $mm^2$ as described above, even if the insulator 4 is inclined to some extend during the sintering as shown in FIG. 12, the insulator 4 is not easily deformed.

Specifically, the length M of the insulator head portion 42 of the spark plug 10*a* is so long that it has a center of gravity at a high position. Therefore, when the insulator 4 is sintered at an inclined state due to the inclinations of the sintering base 8, the front end face 43, and the like, a force produced by the self-weight of the insulator 4 is applied to the insulator 4 in a direction nonparallel to the axial direction of the insulator 4.

However, in the embodiment, because the entire length L of the insulator 4, the length M of the insulator head portion 42, and the projection area S of the insulator head portion front end face 43 are set to be the above-described dimensions, the insulator head portion 42 can be prevented from being deformed. Further, because the outer circumference surface of the insulator head portion 42 is flat and does not have any corrugations, the strength of the insulator 4 in the radial direction is improved. That is, even if the insulator is slightly inclined when it is sintered, the strength against the force applied in the direction non-parallel to the axial direction is improved to prevent the deformation of the insulator 4. In addition, because the insulator head portion 42 has a generally circular cross-section, it becomes difficult for the insulator 4 to be inclined during the sintering.

Figure 10:
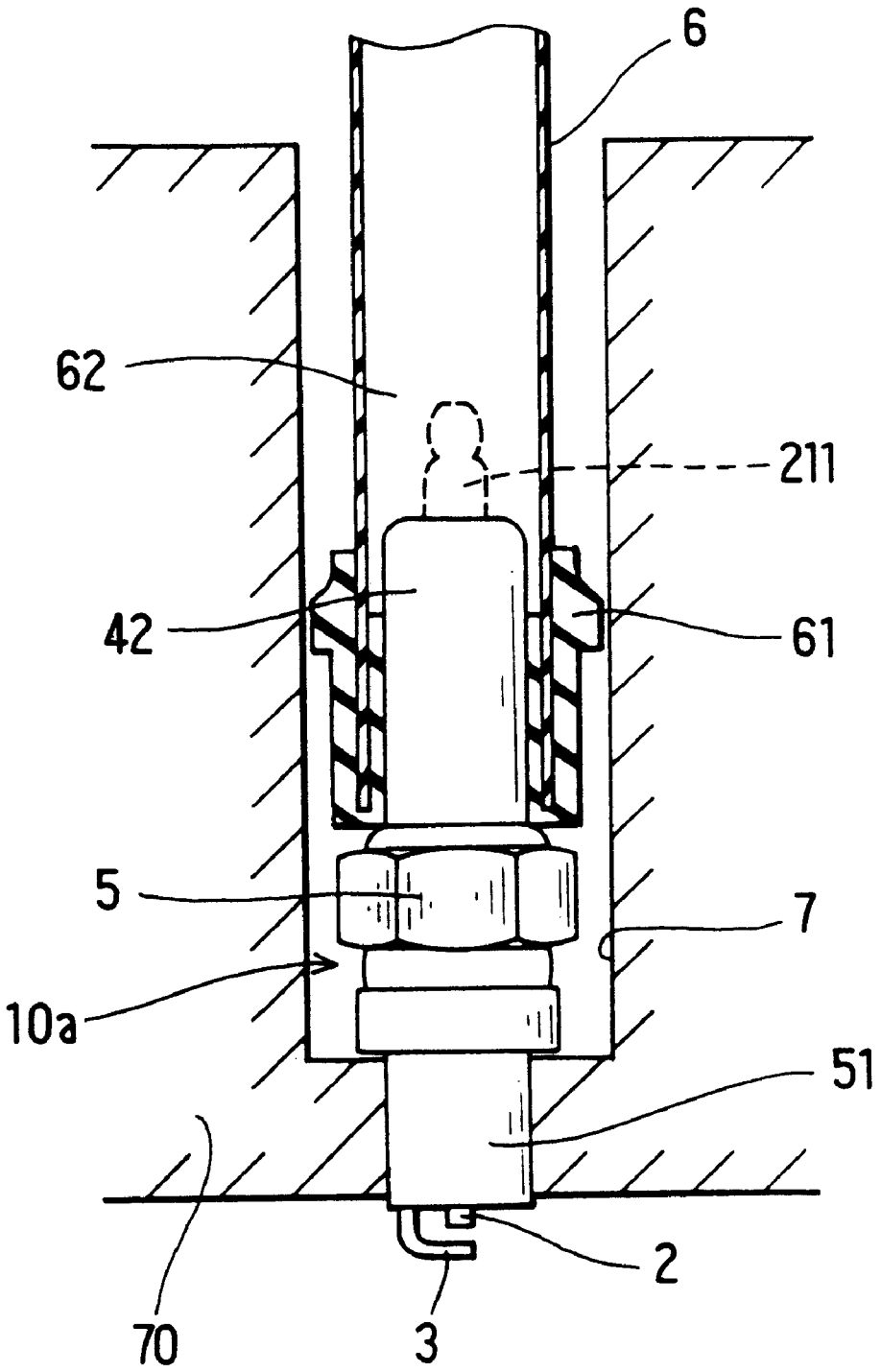
FIG. 10 is an explanatory view showing a state where the spark plug in the second embodiment is installed in a plug hole of an engine.

The spark plug 10*a* constituted above is, as shown in FIG. 10, installed in a plug hole 7 of an internal combustion engine 70 via the screw portion 51 of the housing 5. A plug cap 6 is attached to the insulator head portion 42 so that a cap seal 61 of the plug cap 6 is fitted to the head portion 42. A terminal 62 of the plug cap 6 is electrically connected to the connecting head portion 211 of the spark plug 10*a*. At that time, because the insulator head portion 42 of the spark plug 10*a* in this embodiment is not deformed, the sealing property between the head portion 42 and the cap seal 6 is improved not to cause flash-over (leak at the insulation head portion). The flash-over is liable to be produced when an insulating property between the insulator head portion 42 and the plug cap 6 is lowered. Further, the plug cap 6 can be easily attached to the head portion 42 of the spark plug 10*a* installed in the plug hole 7. That is, according to the second embodiment, the insulator head portion 42 can be sintered without having deformation, resulting in improved sealing property between the cap seal 61 and the insulator head portion 42 and improved attachability of the plug cap 6 to the head portion 42.

Figure 13:
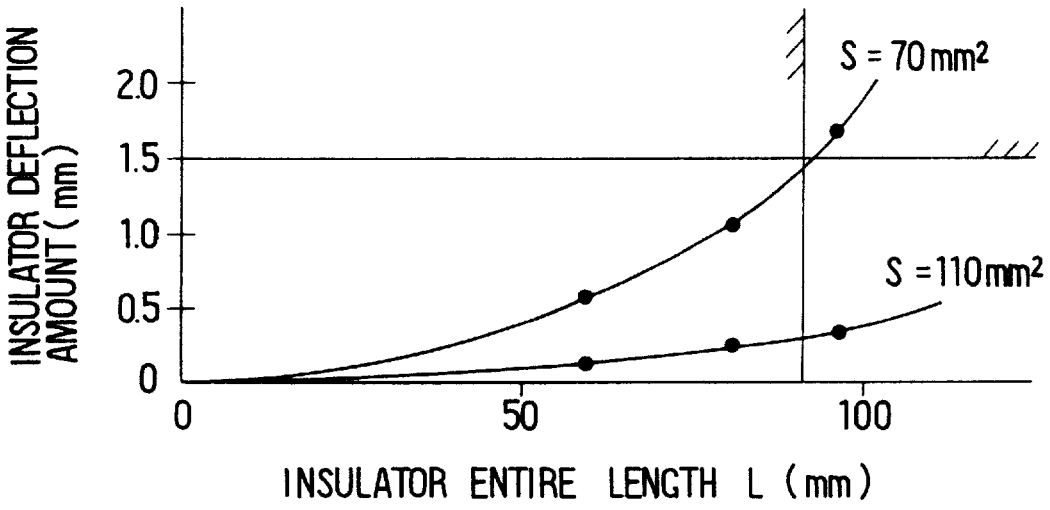
FIG. 13 is a graph showing a difference of insulator deflection amounts caused by a difference of a projection area of an insulator head portion front end face.

Next, experimental results confirming the effects described above will be explained. First, as shown in FIG. 13, relationships between the insulator entire length L and a deflection amount produced when the insulator was sintered were measured. In this test, two types of insulators, in which projection areas S of insulator head portion front end faces were 70 $mm^2$, 110 $mm^2$, respectively, were prepared. The outer circumference faces of the insulator head portions were flat without having any corrugations. The other features of the insulators were the same as those in the second embodiment. Then, in the test, the insulators were sintered at 1500° C., for 24 hours and those deflection amounts were examined.

Figure 15:
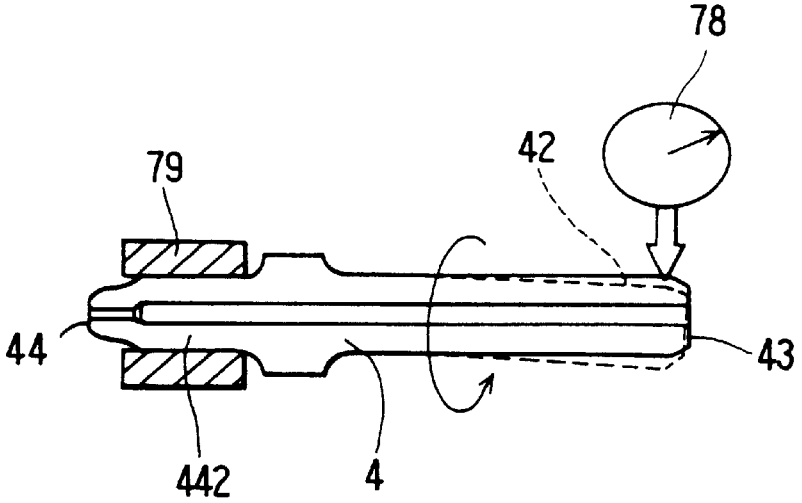
FIG. 15 is a schematic view for explaining a measurement method of the insulator deflection amount indicated in FIGS. 13 and 14.

The deflection amount represents, as shown in FIG. 15, a deflection width of the insulator head portion 42 when the insulator 4 makes one revolution around the axis thereof with the insulator lower portion 442 fixed by a chuck 79. As a method for measuring the deflection width, specifically, a dial gauge 78 is abutted to the outer circumference surface of the insulator head portion front end face 43. Then, indicated values of the dial gauge 78 are read while the insulator 4 makes one revolution. The deflection amount is obtained from a differential value between the maximum value and the minimum value of the indicated values.

The results are shown in FIG. 13. According to the figure, there exists a prominent difference between the insulators of S=70 $mm^2$, and S=110 $mm^2$. In the case where the projection area S is 70 $mm^2$ and the insulator entire length L exceeds 90 mm, the deflection amount of the insulator exceeds 1.5 mm to suddenly increase, meaning that the insulator is largely deformed. On the other hand, in the case where the projection area S is 110 $mm^2$, even if the length L exceeds 90 mm, the deflection amount of the insulator is less than 0.5 mm, meaning that the deformed amount of the insulator is small.

Incidentally, when the length L is smaller than 90 mm, it becomes difficult to desirably lengthen the insulator head portion length M. When the insulator head portion length M is smaller than 40 mm, the sealing property between the insulator head portion and the cap seal may deteriorate. These problems may cause the flash-over. Further when the projection area S is smaller than 80 $mm^2$, the insulator becomes liable to be deformed when it is sintered. On the other hand, the projection area S exceeds 200 $mm^2$, the outer diameter of the insulator head portion front face exceeds 16 mm, resulting in difficult insertion of a high tension cord. When the insulator entire length L exceeds 130 mm or the insulator head portion length M exceeds 80 mm, the center of gravity becomes too high to prevent the deformation of the insulator by the sintering.

Next, the effect of the corrugations on the insulator head portion with respect to the deflection amount of the insulator generated when the insulator was sintered was examined. Two insulators were prepared as test samples. One did not have any corrugations on the outer circumference surface of the insulator head portion as in the second embodiment, and the other had five corrugations on the outer circumference surface of the insulator head portion as a prior art. In both two test samples, the projection area S of the insulator head portion front end face was 110 $mm^2$. The other features of the two test samples were the same as those in the second embodiment.

Figure 14:
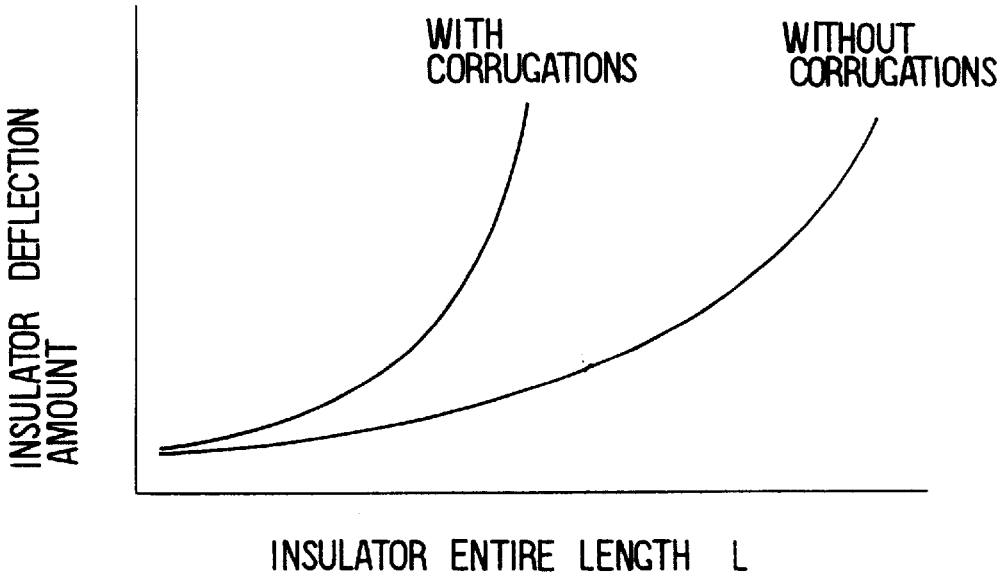
FIG. 14 is a graph showing a difference of insulator deflection amounts between two cases where an insulator head portion has corrugations and does not has any corrugations.

In the test, the insulators were sintered at 1500° C., for 24 hours, and the deflection amounts were measured in the same manner as described above. The results are shown in FIG. 14. Accordingly, it is confirmed that when the insulator head portion has the corrugations, the deflection amount of the insulator largely increases as the entire length L of the insulator increases, as compared to the case where the insulator head portion does not have any corrugations. That is, it is confirmed that the insulator can be prevented from being deformed during the sintering when the insulator head portion dose not have any corrugations. When the insulator head portion must have a corrugation, a difference in diameter of the corrugation, i.e., a protruding height of the corrugation in the radial direction of the insulator should be equal to or less than 0.7 mm to obtained the above-described effects. The number of the corrugations should be less than five.

(Third Embodiment)

Figure 16:
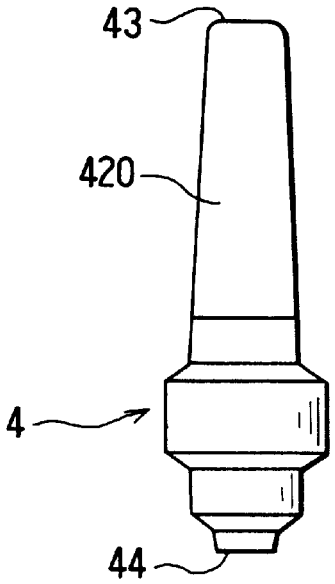
FIG. 16 is a front view showing an insulator in a third preferred embodiment.

In a third preferred embodiment, as shown in FIG. 16, an insulator 4 of a spark plug has a tapered insulator head portion 420. That is, the insulator head portion 420 is formed to have an outer diameter which gradually decreases as it approaches the insulator head portion front end face 43. The other features and obtained effects are the same as those in the second embodiment.

(Fourth Embodiment)

Figure 17:
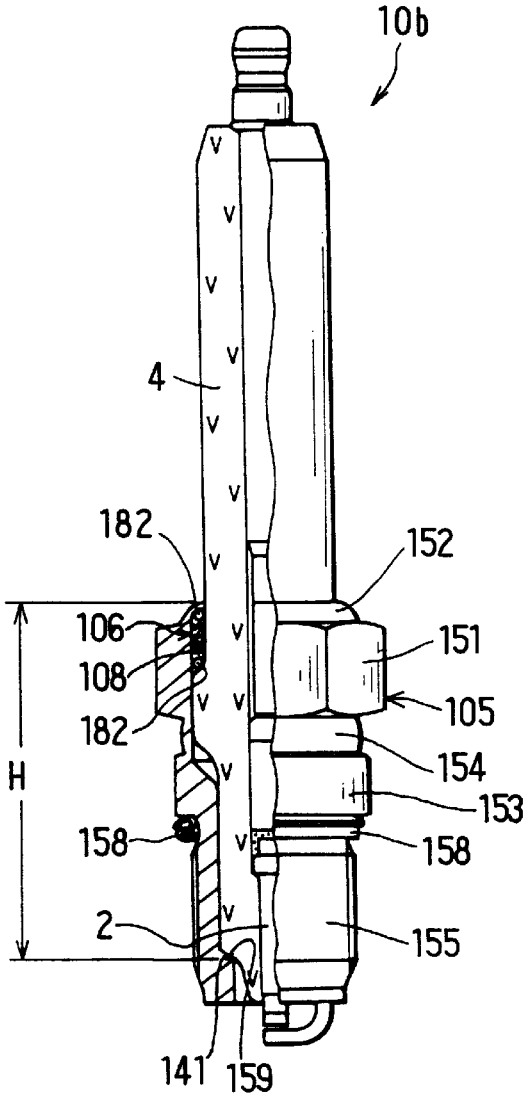
FIG. 17 is a partially cross-sectioned front view showing a spark plug in a fourth preferred embodiment.
Figure 18:
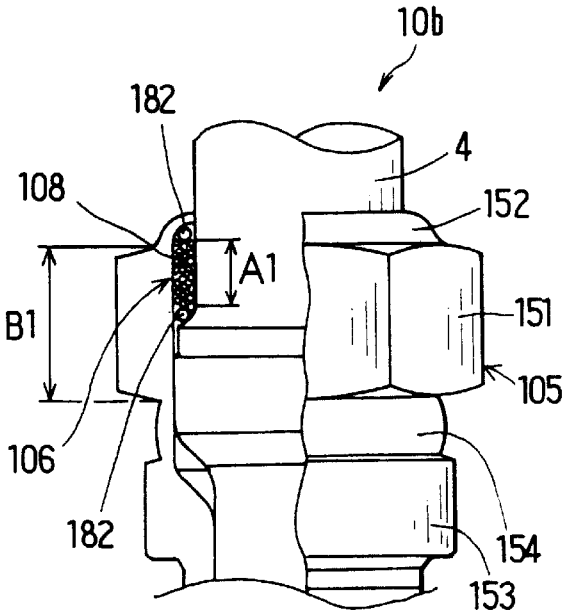
FIG. 18 is a partially cross-sectioned front view showing vicinity of a powdery layer of the spark plug shown in FIG. 17.

A spark plug 10*b* in a fourth preferred embodiment will be explained referring to FIGS. 17–19. The spark plug 10*b* is also a large type suitable for a large engine such as a cogenerator, and as shown in FIG. 17, has an insulator 4 holding a central electrode 2 therein and a housing 105 disposed on the outer circumference of the insulator 4. A ring-shaped space 106 is provided between the insulator 4 and the housing 105, and is filled with a powdery layer 108 for improving air-tightness.

The housing 105 has a polygonal plug attachment portion 151, and the plug attachment portion 151 has a sleeve portion 152 for caulking at an end thereof. The sleeve portion 152 is caulked inwardly to close the ring-shaped space 106 filled with the powdery layer 108. As shown in FIG. 18, a length A1 of the powdery layer 108 in an axial direction of the insulator 4 is in a range of 5 mm to 8 mm, and a length B1 of the plug attachment portion 151 in the axial direction is in a range of 10 mm to 15 mm.

The housing 105 further has a groove portion 154 at an end side of the plug attachment portion 151 opposite the sleeve portion 152, a protruding portion 153 thicker than the groove portion 154, and a screw portion 155 having screw threads in this order. The groove portion 154 is thinner than the plug attachment portion 151. The screw portion 155 has on an inside surface thereof a step portion 159 for abutting an abutting end 141 of the insulator 4 in the axial direction of the insulator 4. A length H between the caulked sleeve portion 152 and a front end of the step portion 159 in the axial direction is equal to or more than 38 mm.

When the spark plug 10*b* is manufactured, the powdery layer 108 is formed after the housing 105 and the insulator 4 are assembled to each other. Then, the sleeve portion 152 is caulked. Specifically, as shown in FIG. 19, first, rings 182 made of carbon steel are disposed at upper and lower portions in the ring-shaped space 106 to enhance the sealing property, and the space 106 between the rings 182 is filled with ceramic powders 80 made of talc, kaolin, or the like.

Figure 19:
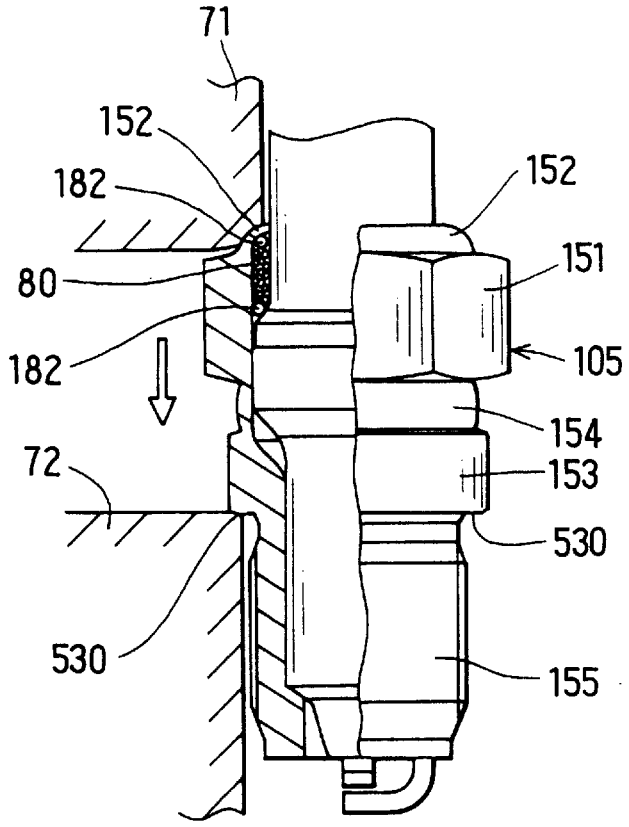
FIG. 19 is an explanatory view showing a method of caulking a sleeve portion of the spark plug shown in FIG. 17.

Next, as schematically shown in FIG. 19, the housing 105 is strongly pinched between a pair of first and second caulking jigs 71, 72 at the sleeve portion 152 and at the end of the lower protruding portion 153 thereof so that the sleeve portion 152 is caulked. Accordingly, the powders 80 and the rings 182 disposed in the ring-shaped space 106 are pressed, thereby forming the powdery layer 180. Incidentally, the screw portion 155 is for being engaged with an engagement hole of an internal combustion engine, and a gasket 158 is disposed at the upper portion of the screw portion 155.

In the spark plug 10*b*, because the length A1 of the powdery layer 108 and the length B1 of the plug attachment portion 151 are set in the specific ranges described above, the sealing property is improved, resulting in improved durability of the spark plug 10*b*. Incidentally, the larger the length A1 becomes, the more the sealing property is improved; however, when the length A1 is less than 5 mm, the effect of improving the sealing property is small. On the other hand, when the length A1 exceeds 8 mm, the workability for forming the powdery layer 108 deteriorates, resulting in increased manufacturing cost of the spark plug.

Further, the longer the length B1 becomes, the more the sealing property is improved. This reason is considered as follows. That is, when the length B1 is long, the distance of the sleeve portion from the internal combustion engine becomes large so that a heat-transfer amount to the sleeve portion is decreased. It is considered that the decreased heat-transfer amount can maintain the effect by the caulking. When the length B1 is less than 10 mm, sufficient sealing property cannot be obtained. On the other hand, when the length B1 exceeds 15 mm, the size of the housing is increased, resulting in undesirable increased size of the spark plug.

In this embodiment, the effects obtained by fixing the lengths A1, B1 in the above-described specific ranges are quantitatively confirmed as follows.

Specifically, the spark plug 10*b* was set in an air-tightness measurement apparatus, and gas (air) having 20 kg/cm$^2$ pressure was supplied from a side of the screw portion 155 into the housing 105. Then, an amount of gas passing through the sleeve portion 152 was measure as a leakage amount. As the other measurement conditions, fastening torque for setting the spark plug 10*b* was 50 Nm and seat temperature (temperature at the gasket 158) was 300° C. As test samples, two types of spark plugs S1, S2 were prepared. In sample S1, the length B1 of the plug attachment portion 151 was set at 10 mm, which was the minimum value in the specific range of the present invention, and the length A1 of the powdery layer 108 was varied. In sample S2, the length B1 was set at 5.4 mm, which was the out of the specific range of the present invention, and the length A1 of the powdery layer 108 was varied as well. Then, the leakage amounts of the respective samples were measured. Incidentally, the length H (see FIG. 17) between the sleeve portion 152 and the front end of the step portion 159 in the axial direction was fixed at 38 mm in respective samples.

Figure 20:
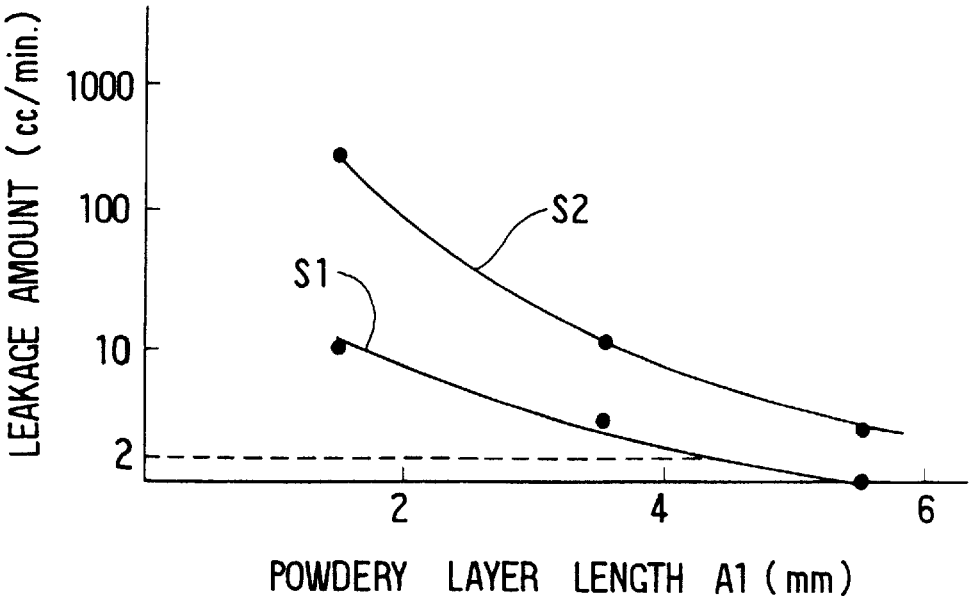
FIG. 20 is a graph showing relationships between a sealing property (leakage amount) of the spark plug and a length of the powdery layer in the fourth embodiment.

The measurement results are shown in FIG. 20. In the figure, the horizontal axis indicates lengths A1 (mm) of the powdery layer 108, while the vertical axis indicates leakage amounts (cc/min.). As understood from the figure, in both samples S1, S2, it is confirmed that the sealing property is improved as the length A1 of the powdery layer 108 is increased. The leakage amount from sample S1 having the length B1 of 10 mm is smaller than that from sample S2 having the length B1 of 5.4 mm in the entire measurement range. Especially when the length A1 is equal to or larger than 5 mm, the leakage amount from sample S1 is less than 2 cc/min., indicating sufficient sealing property.

Next, an effect of a method for caulking the sleeve portion 152 was examined. Specifically, two types of spark plugs S3, S4 were prepared as test samples. In sample S3, the caulking of the sleeve portion 152 was carried out by cold-caulking and hot-caulking, while in sample S4, the caulking of the sleeve portion 152 was carried out only by cold-caulking as described above referring to FIG. 19. In both sample S3, S4, the length A1 of the powdery layer 108 was fixed at 5.5 mm, the length B1 of the plug attachment portion 151 was fixed at 10.7 mm, and the length H (see FIG. 17) was fixed at 38 mm, respectively. Then, the sealing properties of samples S3, S4, i.e., the leakage amounts from samples S3, S4 were measured with respect to the temperature at the gasket 158, substantially in the same manner as described above.

The hot-caulking was, after the cold-caulking was carried out as described above referring to FIG. 19, carried out at a state where the temperature of the groove portion 154 was raised up to approximately 800° C. by supplying a large amount of current (approximately 9000 A) to the housing 105. Further, similarly to the cold-caulking, the hot-caulking was carried out using the first and second caulking jigs 71, 72 shown in FIG. 19.

Figure 21:
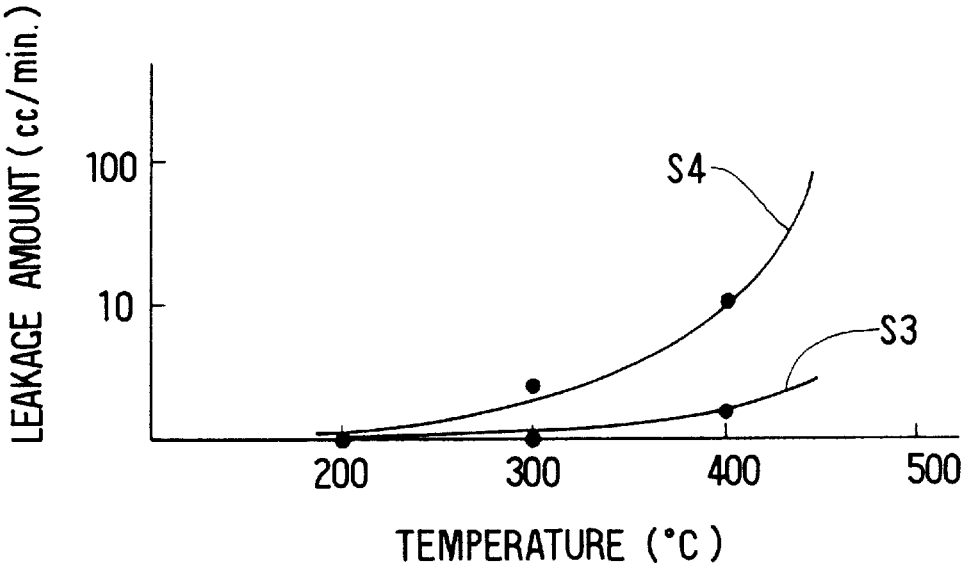
FIG. 21 is a graph showing relationships between a sealing property of the spark plug and temperature in the fourth embodiment.

The measurement results are shown in FIG. 21. In FIG. 21, the horizontal axis indicates temperatures, while the vertical axis indicates leakage amounts. As understood from the figure, the leakage amounts from sample S3 formed by cold-caulking and hot-caulking were smaller than those from sample S4 formed only by cold-caulking. Especially, in a high temperature region, the leakage amount difference between samples S3, S4 was large and sealing property decrease of sample S3 was small as compared to that of sample S4. As a result, it is founded that the hot-caulking is effective to improve the sealing property especially in the high temperature region.

That is, after the cold-caulking, the hot-caulking is carried out in a state where the housing is heated to soften. Accordingly, when the caulked portion returns to the ordinal temperature, the caulked portion is contracted while further fastening the insulator, resulting in further improvement of the sealing property. In the hot-caulking, compressive stress is applied not only to the sleeve portion 152 but also to the groove portion 154 which is softened, causing the improved sealing property between the groove portion 154 and the insulator 4. Preferably, the hot-caulking is carried out when a temperature of the groove portion 154 is equal to or more than 600° C., so that the groove portion 154 is softened to be deformed. More preferably, the hot-caulking is carried out when the temperature of the groove portion 154 is in a range of 850° C. to 900° C.

On the other hand, the cold-caulking is carried out at a temperature less than 100° C. to provide a sufficient hardening property. Preferably, the cold-caulking is carried out at room temperature. In addition, in this embodiment, it is confirmed that the spark plug can provide sufficient sealing property even when the length H is 38 mm or more.

Next, three types of spark plugs S5, S6, S7 having dimensions different from one another were prepared, and those durabilities were examined. The prepared spark plugs had the powdery layer length A1 of 5.5 mm. In sample S5, the length B1 of the plug attachment portion 151 was 5.4 mm, and in samples S6, S7, the length B1 of the plug attachment portion 151 was 10.7 mm. Further, the sleeve portions 152 of samples S5, S6 were caulked only by cold-caulking, while the sleeve portion 152 of sample S7 was caulked by cold-caulking and hot-caulking.

Figure 22:
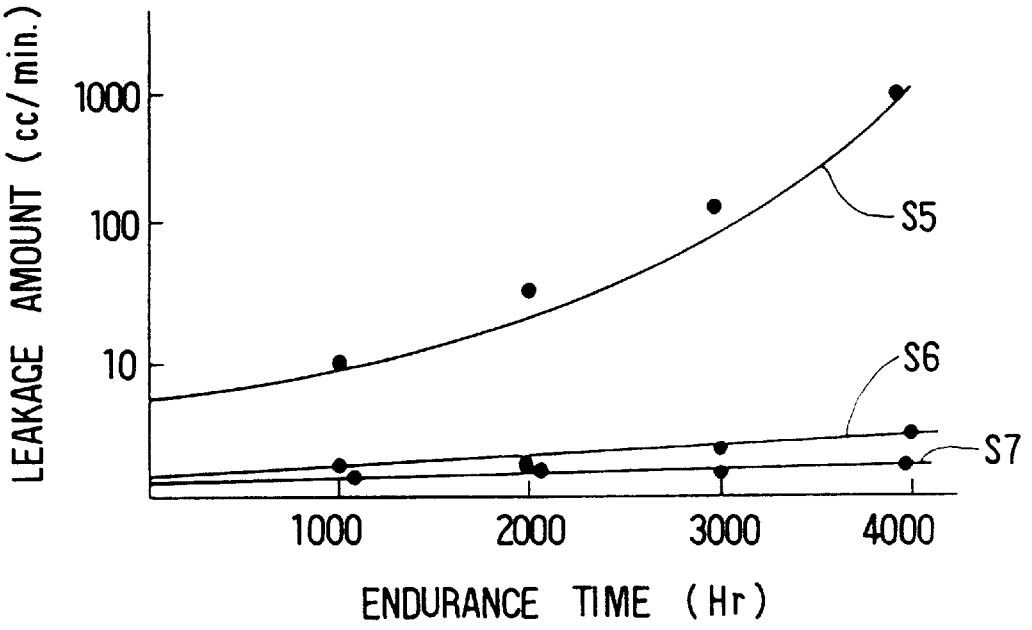
FIG. 22 is a graph showing relationships between a sealing property of the spark plug and endurance time in the fourth embodiment.

Then, the durability of each of the spark plugs was examined based on gas leakage amounts. The gas leakage amounts were measured in the state where the spark plug was attached to a gasoline engine which was driven at an engine speed of 1200 rpm and 100% load. The results are shown in FIG. 22. In the figure, the horizontal axis indicates endurance time (Hr), and the vertical axis indicates leakage amounts. As understood from the figure, comparing sample S5 with sample S6, it is founded that the durability is largely improved when the length B1 of the plug attachment portion is lengthened to 10.7 mm.

Further, when samples S6, S7 have the same dimensions of lengths A1, B1 as described above, the durability of sample S7, to which the cold-caulking and hot-caulking were carried out, is further improved than sample S6 to which only cold-caulking was carried out.

The spark plug in the embodiments is suitable for a cogeneration type internal combustion engine which is operated with an average combustion pressure of 10 kg/cm$^3$ or more.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A spark plug for an internal combustion engine, comprising:

an insulator having a through hole extending in an axial direction of the insulator and an insulator leg portion at a first end portion in the axial direction;

a resistor disposed in the through hole and formed from a resistive material by welding;

a central electrode disposed in the through hole to face a central electrode side end face of the resistor and protruding from an insulator end face of the insulator leg portion;

a housing holding the insulator therein and having a screw portion for being attached to the internal combustion engine; and an earth electrode fixed to the housing and facing the central electrode to define a spark gap therebetween, wherein a first length between the insulator end face and the central electrode side end face of the resistor is equal to or larger than 1.5 times as large as a second length of the insulator leg portion in the axial direction.

2. The spark plug of claim 1, wherein:

the screw portion of the housing has a diameter equal to or larger than 18 mm, and a screw reach equal to or larger than 12 mm; and the insulator has an insulator head portion at a second end portion opposite the first end portion, the insulator head portion having a diameter equal to or larger than 12.5 mm and a length in the axial direction equal to or larger than 40 mm.

3. The spark plug of claim 1, wherein the resistor is formed by welding a mixture including a carbon system resistive material, ceramic powders, and glass powders.

4. The spark plug of claim 1, wherein an end face of the resistor on an insulator head portion side is closer to the central electrode than an end of the housing on the insulator head portion side.

5. A spark plug for an internal combustion engine, comprising:

an insulator having a through hole extending in an axial direction of the insulator;

a central electrode disposed in the through hole and protruding from an insulator first end face of the insulator in the axial direction;

a terminal electrode disposed in the through hole to be electrically connected to the central electrode and protruding from an insulator second end face of the insulator in the axial direction;

a housing holding at least part of the insulator on a central electrode side; and an earth electrode fixed to the housing and facing the central electrode to define a spark gap therebetween, wherein an entire length of the insulator between the insulator first and second end faces in the axial direction is equal to or larger than 90 mm;

wherein a length between the insulator second end face and an end face of the housing on an insulator second end face side is equal to or larger than 40 mm; and wherein a projection area of the insulator second end face is in a range of 80 $mm^2$ to 200 $mm^2$.

6. The spark plug of claim 5, wherein the entire length of the insulator is in a range of 90 mm to 130 mm.

7. The spark plug of claim 5, wherein the length between the insulator second end face and the end face of the housing is in a range of 40 mm to 80 mm.

8. The spark plug of claim 5, wherein the insulator has a generally circular cross-section in the axial direction.

9. The spark plug of claim 5, wherein an outer circumference surface of the insulator on the insulator second end face side of the housing is flat.

10. The spark plug of claim 5, wherein an outer circumference surface of the insulator on the insulator second end face side of the housing has a corrugation, a difference in diameter of which is equal to or less than 0.7 mm.

11. The spark plug of claim 5, wherein an outer circumference surface of the insulator on the insulator second end face side of the housing has corrugations, a number of which is less than 5.

12. A spark plug for an internal combustion engine, comprising:

an insulator having a through hole extending in an axial direction of the insulator;

a central electrode disposed in the through hole and protruding from an insulator first end face of the insulator in the axial direction;

a cylindrical housing disposed on an outer circumference surface of the insulator and having a polygonal attachment portion for being rotated when the spark plug is attached to the internal combustion engine, and a sleeve portion on a side of the polygonal attachment portion opposite the insulator first end face, the sleeve portion being for forming a ring-shaped space with the outer circumference surface of the insulator by caulking;

an earth electrode fixed to the housing and facing the central electrode with a spark gap therebetween; and a powdery layer filling the ring-shaped space, wherein a length of the powdery layer in the axial direction is in a range of 5 mm to 8 mm; and wherein a length of the polygonal attachment portion in the axial direction is in a range of 10 mm to 15 mm.

13. The spark plug of claim 12, wherein the sleeve portion is caulked by cold-caulking and hot-caulking.

14. The spark plug of claim 13, wherein:

the housing has a step portion on inside surface thereof at an end on an insulator first end face side, the step portion being for receiving the insulator; and a length between the sleeve portion and a front end of the step portion is equal to or larger than 38 mm.

15. The spark plug of claim 13, wherein:

the housing has a thin groove portion on a side of the polygonal attachment portion opposite the sleeve portion, and a thick protruding portion on a side of the groove portion opposite the polygonal attachment portion; and the sleeve portion is caulked by applying a compressive stress between the sleeve portion and the protruding portion in the axial direction.

16. The spark plug of claim 15, wherein:

the cold-caulking is carried out when the groove portion has a temperature lower than 100° C.; and the hot-caulking is carried out when the groove portion has a temperature more than 600° C.

17. The spark plug of claim 12, wherein the internal combustion engine is a cogeneration type which is operated with an average combustion pressure equal to or more than 10 kg/cm3.

18. A spark plug for an internal combustion engine, comprising:

an insulator having a through hole extending in an axial direction of the insulator;

a central electrode disposed in the through hole and protruding from an insulator first end face of the insulator in the axial direction;

a cylindrical housing disposed on an outer circumference surface of the insulator and having a polygonal attachment portion for being rotated when the spark plug is attached to the internal combustion engine, and a sleeve portion on a side of the polygonal attachment portion opposite the insulator first end face, the sleeve portion being for forming a ring-shaped space with the outer circumference surface of the insulator by caulking;

an earth electrode fixed to the housing and facing the central electrode with a spark gap therebetween; and a powdery layer filling the ring-shaped space, wherein the sleeve portion is caulked by cold-caulking and hot-caulking.

19. The spark plug of claim 18, wherein:

the housing has a step portion on inside surface thereof at an end on an insulator first end face side, the step portion being for receiving the insulator; and a length between the sleeve portion and a front end of the step portion is equal to or larger than 38 mm.

20. The spark plug of claim 18, wherein:

the housing has a thin groove portion on a side of the polygonal attachment portion opposite the sleeve portion, and a thick protruding portion on a side of the groove portion opposite the polygonal attachment portion; and the sleeve portion is caulked by applying a compressive stress between the sleeve portion and the protruding portion in the axial direction.

21. The spark plug of claim 20, wherein:

the cold-caulking is carried out when the groove portion has a temperature lower than 100° C.; and the hot-caulking is carried out when the groove portion has a temperature more than 600° C.

* * * * *